US006509881B2

(12) United States Patent
Falk

(10) Patent No.: US 6,509,881 B2
(45) Date of Patent: Jan. 21, 2003

(54) ONE APERTURE SIMULTANEOUS RX-TX-ANTENNA

(75) Inventor: Kent Olof Falk, Mölnlycke (SE)

(73) Assignee: Telefonaktielbolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/902,017

(22) Filed: Jul. 10, 2001

(65) Prior Publication Data

US 2002/0003502 A1 Jan. 10, 2002

(30) Foreign Application Priority Data

Jul. 10, 2000 (SE) ..... 0002602

(51) Int. Cl.[7] ..... H01Q 13/10

(52) U.S. Cl. ..... 343/771; 343/770

(58) Field of Search ..... 343/771, 770, 343/772, 776, 768, 767; 333/21 R, 113

(56) References Cited

U.S. PATENT DOCUMENTS

| | | | | |
|---|---|---|---|---|
| 2,932,823 A | | 4/1960 | Beck et al. | 343/771 |
| 3,005,984 A | | 10/1961 | Winter et al. | 343/771 |
| 3,135,959 A | | 6/1964 | Moran | 343/768 |
| 3,193,830 A | | 7/1965 | Provencher | 343/771 |
| 3,369,244 A | | 2/1968 | Masters | 343/771 |
| 3,524,189 A | | 8/1970 | Jones, Jr. | 343/771 |
| 4,623,894 A | | 11/1986 | Lee et al. | 343/770 MS |
| 4,812,789 A | * | 3/1989 | Lee | 333/135 |
| 5,793,330 A | | 8/1998 | Gans et al. | 343/700 MS |
| 5,831,583 A | | 11/1998 | Lagerstedt et al. | 343/771 |

FOREIGN PATENT DOCUMENTS

EP 0 440 126 A1 8/1991

* cited by examiner

*Primary Examiner*—Don Wong
*Assistant Examiner*—James Clinger

(57) ABSTRACT

An antenna for simultaneous microwave transmission and reception is disclosed. The antenna comprises an array of wave-guides (10, 16) arranged side-by-side. In a typical embodiment of the array the wave-guides are rectangular wave-guides comprising a symmetrically or un-symmetrically placed ridge (8) and forming an array of vertical or horizontal columns. Opposite to the ridge at a second wall of the rectangular wave-guide slots (20, 21, 27, 28) are provided in the front wall, each aperture wave-guide being made narrow-band tuned for a respective transmitting or a receiving frequency in order to achieve a low coupling between transmitting and receiving to facilitate simultaneous transmission and reception at equal polarisation. Furthermore parallel to the array of slotted wave-guides a wave-guide filter (30, 35) may be arranged at each side forming a respective transmitting signal filter and a receiving signal filter to form a compact single aperture transmit/receive microwave antenna unit. In the typical embodiment slots are cut in a direction parallel to the extension of the wave-guide columns. Every second slot is further positioned displaced to each side of an $E_{MAX}$ at the front wall. In a further embodiment presenting a different transmit and receive polarisation either the receive or transmit portion comprises regular rectangular wave-guides, which present radiating slots in their front facing short side wall. These slots are directed at an angle across the front wall of the column thereby generating a different polarisation between the simultaneous transmission and reception portions of the antenna array.

15 Claims, 2 Drawing Sheets

ONE APERTURE SIMULTANEOUS RX-TX-ANTENNA

This application claims priority under 35 U.S.C. §§119 and/or 365 to 0002602-1 filed in Sweden on Jul. 10, 2000; the entire content of which is hereby incorporated by reference.

TECHNICAL FIELD

The present invention relates to a single aperture simultaneous receive/transmit antenna, and more specific an integrated aperture using narrow-band parallel side-by-side slotted ridge wave-guides for simultaneous transmission and reception.

BACKGROUND

In radio communication it has often been found that the separation between the Rx and Tx signal may be a problem i certain applications. This problem is further accentuated when the development goes towards even a more dense packing in frequency between the Rx and Tx signals. At the same time it would be desirable to avoid having two separate apertures for Rx and Tx, respectively. Examples of applications are links of different types on the ground or between ground and satellites.

In order to in a same aperture integrate receive and transmit antenna for simultaneous transmission and reception there is a problem, in particular with adjacent transmit and receive frequencies. Besides it would be desirable to include matching such that power amplifiers and low noise amplifiers may be connected to a respective port without further devices necessary. The state of the art discloses generally two kinds of solutions to the basic problem. One type of known solutions utilises a reflector antenna having a two-band feeder and diplexers. Other types instead utilise two separate apertures.

For instance, U.S. Pat. No. 4,623,894 discloses a dual band array antenna having interleaved wave-guide and dipole arrays, which each operates i a different frequency band. The solution presents a mixed design having a plurality of open-ended wave-guides operating at a first frequency of a first frequency band and a plurality of microstrip dipoles operating at a second frequency in a second frequency band. As a result two beams of two different frequency bands are independently and simultaneously steerable in a single antenna aperture.

Another U.S. Pat. No. 5,793,330 presents an interleaved planar array antenna system providing opposite circular polarisation and comprises an array of parallel rows of parallel spaced transmit dipole radiating elements and an array of parallel rows of parallel spaced receive dipole elements. The receive dipole elements are oriented orthogonal to the transmitting dipole elements. In an illustrative embodiment the antenna system operates in two 0.5 GHz bands starting at 7.25 and 7.90 GHz, respectively, using an expected frequency separation of the order of 0.65 GHz. Still another U.S. Pat No. 5,638,079 discloses a slotted wave-guide array antenna including a plurality of wave-guide elements extending in a parallel side-by-side relation, each having a radiating side including a broad wall formed with a plurality of slots and an asymmetric ridge. The slots are slanted in relation to the longitudinal axis of the antenna in alternating directions and are spaced $\lambda_g/2$ apart such as to offset phase reversal between each pair of adjacent slots. By operating each of the groups of ridge wave-guides a selectable orthogonal linear polarisation can be obtained or by operating all the ridge wave-guides together in phase quadrature a circular polarisation is generated. However, the arrangement is intended for either transmit or receive operation, but not simultaneous transmit/receive operation.

There is for instance for link applications a demand for a compact antenna array, which utilises the same aperture for simultaneous transmitting and reception. Such an array should even be able to use the same polarisation for both transmission and reception to, for instance in a link network, not even have to keep track of what could be referred to as odd or even sites regarding transmit or receive polarisation.

SUMMARY

An antenna device for microwave transmission and reception is disclosed which utilises an array of wave-guides arranged side-by-side. In a typical embodiment of the array the wave-guides are rectangular wave-guides having a ridge and positioned in parallel to form an array of vertical or horizontal columns. Opposite to the ridge at a second wall of the rectangular wave-guide slots are provided in the front wall, each aperture wave-guide being made narrow-band tuned for a respective transmitting or a receiving frequency in order to achieve a low coupling between transmitting and receiving to facilitate simultaneous transmission and reception. Furthermore parallel to the array of ridge wave-guides a wave-guide filter may be arranged at each side forming a respective transmitting signal filter and a receiving signal filter forming a compact single aperture transmit/receive microwave antenna unit. In a general embodiment the slots are cut in a direction parallel to the extension of the wave-guide columns and arranged in a front wall facing a second wall carrying the ridge, which may be positioned symmetrically. Every second slot further being positioned displaced to each side of an $E_{MAX}$ line defined in the front wall. In a further embodiment either the receive or transmit portion comprises regular rectangular wave-guides which present radiating slots in their front facing side-wall. These slots are directed at an angle across the front wall of the column to thereby obtain a different polarisation between the simultaneous transmission and reception.

An antenna device according to the present invention is set forth by the independent claims 1 and 6, and further embodiments of the invention are set forth by the dependent claims 2 to 5 and 7 to 14, respectively.

BRIEF DESCRIPTION OF THE DRAWINGS

The invention, together with further objects and advantages thereof, may best be understood by making reference to the following description taken together with the accompanying drawings, in which.

DESCRIPTION

Figure 1:
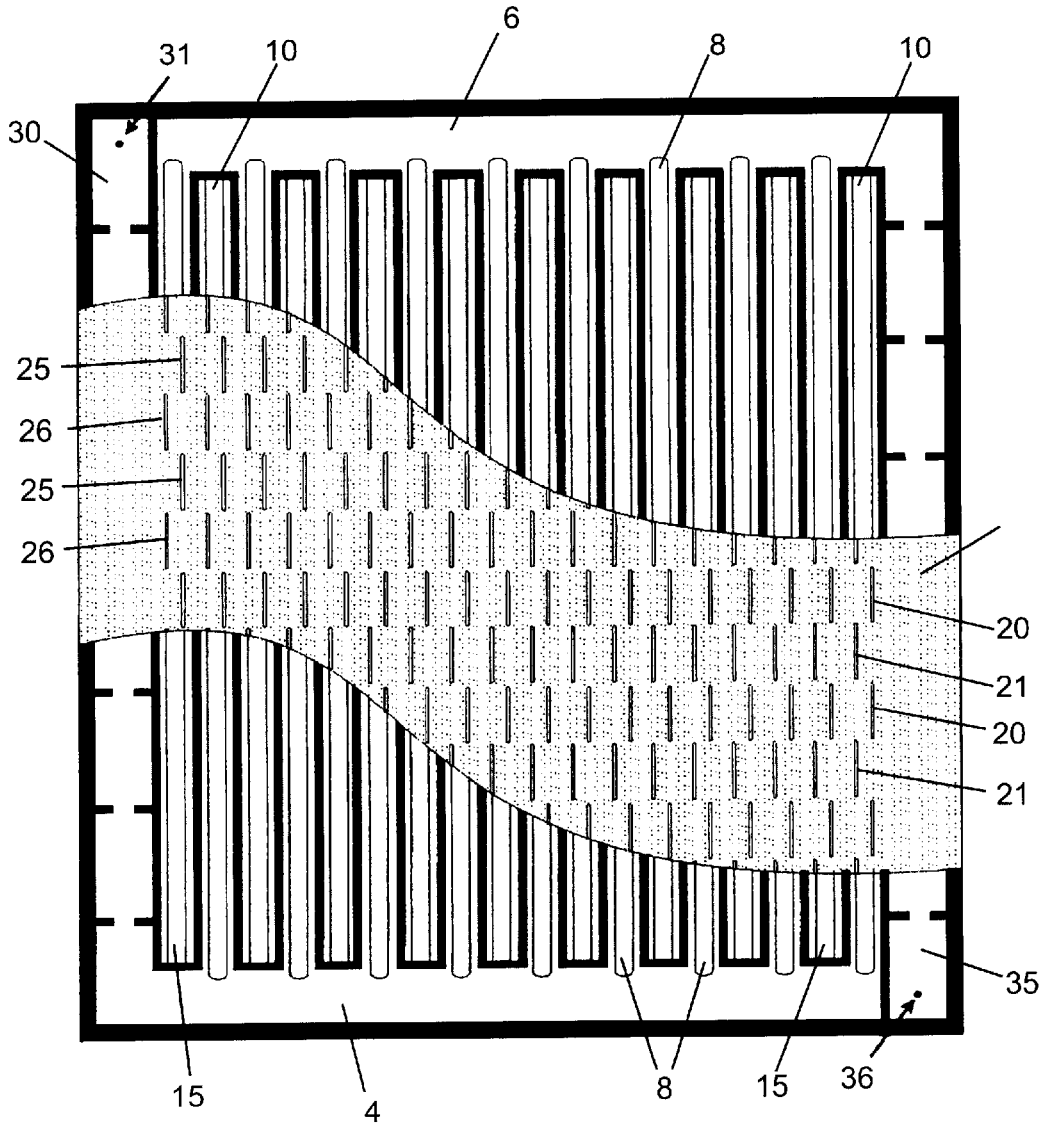
FIG. 1 illustrates a front view, partly sectioned, of an antenna arrangement according to the present invention using narrow-band parallel side-by-side slotted ridge wave-guides for simultaneous transmission and reception.

In FIG. 1 is demonstrated a first embodiment of an antenna array for single aperture simultaneous transmission and reception. The antenna is realised using parallel slotted ridge wave-guides in an array where every second wave-guide 10, fed by a feeding wave-guide 4, forms a receiving portion while the remaining slotted ridge wave-guides 15 fed by a feeding wave-guide 6 form the transmitting portion of the common antenna aperture. As the antenna aperture has the same polarisation for both transmission and reception it provides, for instance, a practical arrangement in a link network, as it will not be necessary to keep track of the individual link when all utilises the same polarisation.

If necessary a wave-guide filter 30 for the receiving portion and a wave-guide filter 35 for the transmitting portion may be integrated with a matching wave-guide along the aperture at two opposing side edges for obtaining coaxial connections or corresponding connections to a preamplifier and a power amplifier, respectively. The wave-guide or wave-guide filters then are terminated by a coaxial wave-guide converter. Each converter consists in an illustrative embodiment of a pin 31 and 36, respectively, which for instance may be connected to a micro-strip conductor at the back of the aperture. It should be noted that the two wave-guide filters 30 and 35 are equally arranged, in the present embodiment of FIG. 1, at the two vertical sides of the antenna aperture when using the same polarisation for the transmit and receive frequencies. 1o For almost all slotted resonant wave-guide antennas the number of slots per aperture wave-guide will decide the bandwidth. Only as an exception for the smallest antenna device presenting only about three or less slots per aperture wave-guide the bandwidth of the individual slots will be decisive.

Of course it is also possible to influence the bandwidth of the slots by i s affecting their form, which is well known by a person skilled in the art. However it is difficult to obtain a bandwidth of more than 20% related to the centre frequency. Therefore filters would in reality be necessary only if an antenna is to be realised with bandwidth in percent being less than about 30 divided by the number of slots in each aperture wave-guide, or if the number of slots is equal to or less than three. Thus an aperture wave-guide comprising an order of 30 slots will provide a bandwidth of the order 1%. However it should also be noted that the feeding wave-guide 4 (or 6) itself also gives a reduction of the bandwidth.

Figure 2:
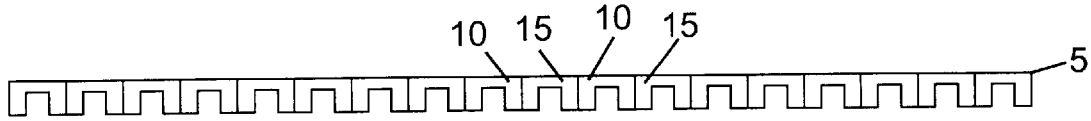
FIG. 2 illustrates a horizontal cross section of a portion of the aperture according to FIG. 1 showing the side-by-side ridge wave-guides.

Choosing ridge wave-guides is favourable, particularly when using slots aligned with the extension of the columns. This is favourable for the width of the array in that along a direction across the antenna aperture two wave-guides will be housed into a space less than a wavelength of free space. FIG. 2 illustrates a horizontal cross section of a portion of the aperture according to FIG. 1 showing the side-by-side ridge wave-guides 10 and 15 for reception and transmission respectively, but excluding filters 30 and 35. In this illustrative embodiment the entire device will consist of two main portions, one block providing sides and bottom including the ridge 8 for all of the wave-guides 10 and 15 and a front plate 5 including, for each of the aperture wave-guides, the columns of front side slots 20, 21 and 25, 26 respectively. The main block may be machined by milling a piece of suitable metal, which then in an joining process, like soldering, will be attached to the front plate 5 presenting the radiating slots. In another embodiment metallized plastic pieces may be manufactured for obtaining the desired structure. Such metallized pieces may, for instance, be manufactured in a moulding process.

An important feature to be particularly noted is that receive and transmit antenna portions are designed very narrow-band such that the coupling between the aperture wave-guides of the two antenna transmit and receive portions effectively becomes small to be able to utilise simultaneous transmission and reception. This is obtained by a design of the receiving antenna portion presenting a performance being low enough at the transmit frequency, and equally designing the transmit antenna portion presenting a performance being low at the receive frequency used. This is generally accomplished by designing the radiating aperture wave-guides be narrow band tuned, i.e. the number of slots making each aperture wave-guide representing a high Q due to a chosen shape and number of slots.

For the basic mode in an aperture wave-guide having slots at the wide side of the rectangular form there is always a point at the inner side of the slotted wall where the orthogonal E-field towards the wall has a maximum, $E_{MAX}$. The longitudinal component of the current will have different sign at a respective side of the maximum of this E-field. By moving half a wave-guide wavelength forward in the wave-guide relative to a slot and position a next slot at the other side of this maximum of the E-filed both slots will obtain the same phase.

Thus, the radiators formed by the slots along the extension of each column which consist of a ridge wave-guide, are in a typical embodiment arranged in a front wall of the rectangular wave-guides and positioned opposite to the wall carrying a ridge 8 of the wave-guide, which ridge may as illustrated in the illustrative embodiment be positioned symmetrically within each wave-guide. Every second slot 20, 21 and 25, 26, respectively, in the wave-guide front surface are further displaced to either side of the $E_{MAX}$ line. This arrangement also allows a large number of slots in each column along the ridge wave-guides. Even if a symmetrically positioned ridge provides a practical embodiment also the use of a ridge not positioned symmetrically may be utilised, for instance, in an application for a reduction of what is referred to as butterfly lobes, when the use of symmetrical ridges may be disadvantageous.

In a design for frequencies around 40 GHz a transmit/receive frequency separation of 0.9 GHz and a band separation of 0.1 GHz have been obtained with a measured attenuation between transmit and reception portions of the order of 20 dB without optional filtering. Including the integrated wave-guide filters 30 and 35 attenuation between transmitting and receiving frequency of better than 60 dB was obtained.

Figure 3:
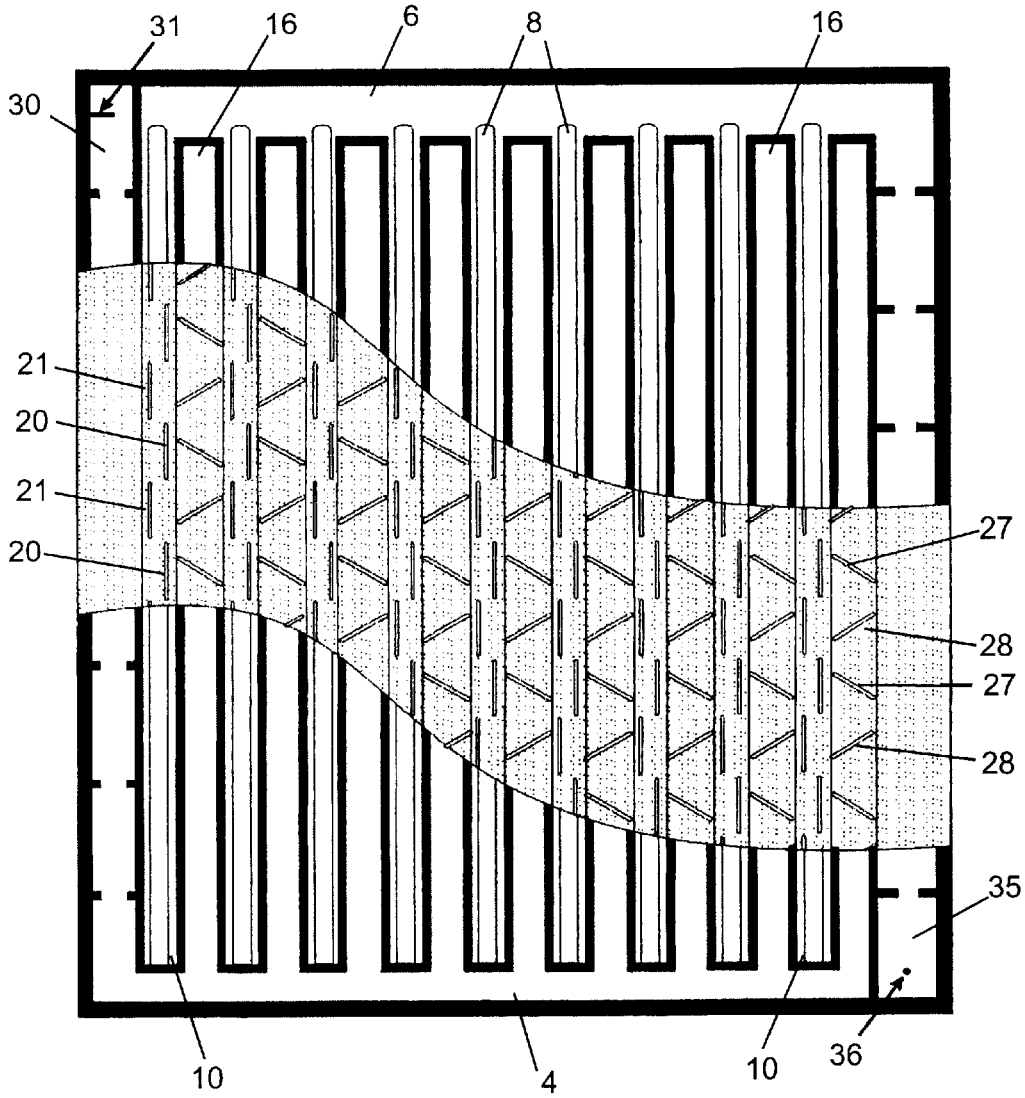
FIG. 3 illustrates a front view, partly sectioned, of a further embodiment of a single aperture simultaneous transmitting and receiving antenna according to the present invention using a mix of ridge wave-guides and ordinary rectangular wave-guides.
Figure 4:
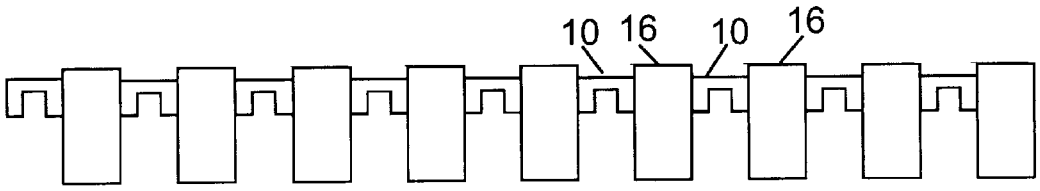
FIG. 4 illustrates a horizontal cross section of a portion of the aperture according to FIG. 3 showing the side-by-side ridge wave-guides and rectangular wave-guides.

In FIG. 3 is demonstrated an alternative embodiment of the present invention for a case in which a same polarisation of transmit and receive antenna portion of the aperture is not desired. As a trade off this second embodiment will provide further isolation between a transmitting and a receiving portion of the aperture for simultaneous transmission and reception. In FIG. 4 is demonstrated a number of wave-guides 10 and 16 arranged side-by-side, whereby wave-guides 10 represent slotted ridge wave-guides equal to those shown in FIG. 1, while the wave-guides 16 represent ordinary rectangular wave-guides in which slots are arranged across a short side wall of the rectangular wave-guide.

FIG. 3 illustrates in a front view, partly sectioned, the second embodiment of the single aperture simultaneous transmitting and receiving antenna device according to the present invention using a mix of ridge wave-guides and ordinary rectangular wave-guides. The second embodiment illustrated in FIG. 3 also illustrates a matching and a wave-guide filter at each side of the array of ridge wave-guides 10 and ordinary rectangular wave-guides 16. However, it should be noted that the matching filter feeding the slotted wave-guides 16 is turned by 90 degrees and presents a short side-wall towards the front of the aperture. It is easily seen that the left side filter is slightly narrower than the right side filter and that the connector pin 31 is seen from the side.

The slots of the rectangular wave-guides 16 are created at an angle across the short side-wall of a rectangular wave-guides because the length of each slot 27, 28 will be slightly longer than the measure across the short side. To compensate for this positioning of the slots every second slot is at an angle in relation to the extension of the rectangular wave-guide, which alternately is plus or minus the angle in a plane perpendicular to the extension of the rectangular wave-guide.

Because the slots 27, 28 are made as long as possible they will reach out to the edge of the short side. It is seen in FIG. 3 that the short side of each one of the rectangular wave-guides 16 in the array is shooting up a little compared to the ridge wave-guides 10. This makes the production of this embodiment a slightly more complicated, but an even better attenuation between transmit and receive portions of the single aperture antenna will be achieved in this case due to the different polarisation obtained for the transmit and receive signals.

It will be obvious to a person skilled in the art that, in the first embodiment, a portion containing either the ridge wave-guides 10 or 15 may be selected and designed as the transmit portion. Equally in the second embodiment either the array portion containing the ridge wave-guides 10 or the array portion containing the ordinary rectangular wave-guides 16 can be selected and designed to constitute the transmit portion of the aperture. However as the radiators should be tuned narrow frequency it must be decided in manufacturing which portion should be matched for a selected transmit frequency and which portion should be matched for a selected receiving frequency.

It will be appreciated by those of ordinary skill in the art that the present invention can be embodied in other specific forms, without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. Antenna device utilising ridge wave-guides being positioned in parallel to form an array of radiating slotted columns, the wave-guides further forming compact rectangular wave-guides having a ridge, wherein said device is adapted for simultaneous microwave transmission and reception of signals of a same polarisation;

opposite to the ridge at a second wall of a rectangular aperture wave-guide slots are provided in a first wall and cut in a direction parallel to the extension of the ridge wave-guide, each aperture wave-guide radiator being made primarily narrow-band tuned by its number of slots for a respective transmitting or receiving frequency in order to achieve a low coupling between transmitting and receiving to facilitate the simultaneous transmission and reception; and said rectangular aperture wave-guide radiator every second slot cut in the direction parallel to the extension of said rectangular ridge wave-guides is positioned displaced to an alternating side of an $E_{MAX}$ line of said aperture wave-guide first wall.

2. Antenna device according to claim 1, wherein each ridge wave-guide contains a ridge positioned symmetrically with respect to a center line of each respective wave-guide.

3. Antenna device according to claim 1, wherein every second ridge aperture wave-guide is narrow-band tuned to a transmitting frequency or a receiving frequency, while the remaining ridge aperture wave-guides correspondingly are narrow-band tuned to a corresponding receiving frequency or a corresponding transmitting frequency.

4. Antenna device according to claim 2, wherein every second ridge aperture wave-guide is narrow-band tuned to a transmitting frequency or a receiving frequency, while the remaining ridge aperture wave-guides correspondingly are narrow-band tuned to a corresponding receiving frequency or a corresponding transmitting frequency.

5. Antenna device according to claim 1, wherein parallel to said array of aperture wave-guides a matching and wave-guide filter is arranged at each side forming a transmitting signal filter and a receiving signal filter, whereby said device forms a compact single aperture simultaneous transmit/receive microwave antenna.

6. Antenna device for microwave transmission and reception utilizing rectangular slotted aperture wave-guides, wherein every second aperture wave-guide is a rectangular wave-guide and every other aperture wave-guide forms a rectangular ridge wave-guide, the wave-guides being positioned in parallel to form two interleaved arrays with orthogonal linear polarization; and slots are provided in a first wall of each one of said aperture wave-guides of the arrays, each aperture wave-guide being made primarily narrow-band tuned by its number of slots for a respective transmitting or receiving frequency in order to achieve low coupling between transmitting and receiving arrays to facilitate simultaneous transmission and reception.

7. Antenna device according to claim 6, wherein each one of said rectangular ridge wave-guides contains a ridge positioned symmetrically with respect to a center line of each respective wave-guide.

8. Antenna device according to claim 6, wherein every rectangular ridge wave-guide present slots along the extension of a first wall facing a second wall carrying said ridge, and every second slot along said first wall being parallel to but positioned displaced to each side of an $E_{MAX}$ line of said first wall, while remaining rectangular wave-guides are presenting slots in a first wall being cut at an angle across said rectangular wave-guide front wall in relation to the extension of said rectangular wave-guide.

9. Antenna device according to claim 7, wherein every rectangular ridge wave-guide present slots along the extension of a first wall facing a second wall carrying said ridge, and every second slot along said first wall being parallel to but positioned displaced to each side of an $E_{MAX}$ line of said first wall, while remaining rectangular wave-guides are presenting slots in a first wall being cut at an angle across said rectangular wave-guide front wall in relation to the extension of said rectangular wave-guide.

10. Antenna device according to claim 6, wherein every second slot of said rectangular wave-guides is cut at an angle across said rectangular wave-guide front wall and alternately positioned at plus or minus this angle related to a plane perpendicular to the extension of said rectangular wave-guide.

11. Antenna device according to claim 7, wherein every second slot of said rectangular wave-guides is cut at an angle across said rectangular wave-guide front wall and alternately positioned at plus or minus this angle related to a plane perpendicular to the extension of said rectangular wave-guide.

12. Antenna device according to claim 6, wherein every second aperture wave-guide is narrow-band tuned to a transmitting frequency or a receiving frequency, while remaining aperture wave-guides correspondingly are narrow-band tuned to a corresponding receiving frequency or a corresponding transmitting frequency.

13. Antenna device according to claim 7, wherein every second aperture wave-guide is narrow-band tuned to a transmitting frequency or a receiving frequency, while remaining aperture wave-guides correspondingly are narrow-band tuned to a corresponding receiving frequency or a corresponding transmitting frequency.

14. Antenna device according to claim 6, wherein parallel to said array of aperture wave-guides a matching and wave-guide filter is arranged at each side forming a transmitting signal filter and a receiving signal filter, whereby said device forms a compact single aperture simultaneous transmit/receive microwave antenna.

15. Antenna device according to claim 6, wherein the every second aperture wave-guide is fed from a first feeding wave guide and the every other aperture wave-guide is fed from a second feeding wave guide on a different side of the antenna device from the first feeding wave guide.

* * * * *

UNITED STATES PATENT AND TRADEMARK OFFICE

CERTIFICATE OF CORRECTION

PATENT NO. : 6,509,881 B2
DATED : January 21, 2003
INVENTOR(S) : Kent Olof Falk

It is certified that error appears in the above-identified patent and that said Letters Patent is hereby corrected as shown below:

Title page,
Item [73], Assignee, replace "Telefonaktielbolaget" with -- Telefonaktiebolaget --

Signed and Sealed this

Twenty-third Day of March, 2004

JON W. DUDAS
*Acting Director of the United States Patent and Trademark Office*